United States Patent [19]

Cherry

[11] Patent Number: 4,553,003

[45] Date of Patent: Nov. 12, 1985

[54] CUP TYPE VACUUM INTERRUPTER CONTACT

[75] Inventor: Sidney J. Cherry, Elmira, N.Y.

[73] Assignee: Westinghouse Electric Corp., Pittsburgh, Pa.

[21] Appl. No.: 595,071

[22] Filed: Mar. 30, 1984

[51] Int. Cl.[4] ..... H01H 33/66

[52] U.S. Cl. ..... 200/144 B; 200/262; 200/265; 200/266

[58] Field of Search ..... 200/144 B, 262, 265, 200/266

[56] References Cited

U.S. PATENT DOCUMENTS 4,149,050 4/1979 Gorman et al. ..... 200/144 B
4,419,551 12/1983 Kato ..... 200/144 B
4,438,307 3/1984 Lippmann et al. ..... 200/144 B

FOREIGN PATENT DOCUMENTS 1100259 1/1968 United Kingdom ..... 200/144 B

*Primary Examiner*—Robert S. Macon
*Attorney, Agent, or Firm*—C. L. Menzemer

[57] ABSTRACT

The present invention is directed to a cup type vacuum interrupter contact comprised of a holder portion and a contact portion. The holder portion is cup shaped and has a base and side walls extending vertically from the base. The contact portion is circular in configuration corresponding approximately in shape and cross-sectional area to the side walls of the holder portion and is disposed on and affixed to the rim of the side walls. The holder portion has slots extending at an angle from its base through the side walls to the rim. The holder portion is comprised of a precipitation-hardened copper alloy and the contact portion is comprised of copper.

10 Claims, 7 Drawing Figures

CUP TYPE VACUUM INTERRUPTER CONTACT

BACKGROUND OF THE INVENTION

1. Field of the Invention

The present invention is in the field of vacuum interrupters generally and is particularly directed to the composition of a vacuum interrupter electrical contact.

2. Description of the Prior Art

In a vacuum interrupter the current normally flows between and through a pair of electrical contacts located within an evacuated envelope. These contacts are relatively movable between a closed position in engagement and an open position spaced apart to interrupt the current flow through the vacuum interrupter. As the contacts are separated an arc is formed therebetween and current will continue to flow until this arc is extinguished, which on an alternating current circuit will normally occur near the first current zero. The contact surface must support the arc from its initiation at the time of contact separation until its extinction at approximately current zero. While the arc is being sustained the contacts are subjected to very intense localized heating. The dissipated arc energy causes melting, erosion and general deterioration of the contact surfaces. To minimize deterioration of the contact surfaces, it is customary to move the arc around the contact surface. Such arc movement tends to minimize the amount of metallic vapors or particles generated by the arc from the contact surfaces during circuit interruption. This arc movement is usually accomplished by self-induced magnetic fields as more fully explained in prior art U.S. Pat. No. 3,089,936 issued May 14, 1963 to S. R. Smith, Jr. and U.S. Pat. No. 3,417,216 issued Dec. 17, 1968 to S. R. Smith, Jr.

One prior art method for moving the arc around the contact surface is to form slots in at least a portion of the contacts.

As pointed out in U.S. Pat. No. 3,087,936 Supra these slots may extend to the mating surfaces of the opposed contacts or as pointed out in U.S. Pat. No. 4,149,050 issued Apr. 10, 979 to Gorman et al., as in the present invention, the contact may have a cup-shaped holder portion in which the slots are formed and a contacting portion affixed to the holder portion and which mates with the contacting portion of the opposed contact.

In either case, as pointed out in U.S. Pat. No. 4,390,762 issued June 28, 1983 to Watzke, the slots result in decreasing the overall strength of the contact. The contacts are partially compressed by the switching load in the course of the contacts life. As a result of the compression, the stroke of the vacuum interrupted must be adjusted after as few as 300 or even less switchings.

Attempts have been made to reinforce the slotted portion of the contacts.

Watzke, Supra, teaches reinforcing the slotted portion of the contact with a steel ring member disposed concentrically within the slotted portion.

British Pat. No. 1,142,209 teaches disposing a plurality of reinforcing strips of a resilient metal, as for example molybdenum or a refractory metal, in the slotted portion of the contact. The strips run parallel to the vertical axis of the contact. British Pat. No. 1,100,259 also is directed to reinforcing strips.

British Pat. No. 1,129,152 teaches making the contacts out of a copper-iron alloy, 1% to 5% iron, by weight, to prevent or at least to retard compression.

The proposed prior art solutions all suffer from the same shortcoming. The conductivity of the contact is reduced relative to copper by the addition of the reinforcing metal and as a result the temperature of the current carrying lead is increased during the current conduction period.

SUMMARY OF THE INVENTION

In accordance with the teachings of this invention an improved cup-shaped vacuum interrupter contact is provided. The contact of this invention is able to withstand the compressive force resulting from the repeated closings of the contacts and will not be deformed by such compressive force. While at the same time the contact has good electrical conductivity properties.

The vacuum type circuit interrupter of this invention comprising a pair of relatively movable contacts, said contacts being movable between a closed position in engagement and an open position, when in the open position said contacts form an arcing gap therebetween across which an arc can form during circuit interruption; an evacuated housing disposed about and enclosing said pair of contacts, at least one of said contacts comprising a cup-shaped holder portion and a contacting portion, said cup-shaped holder portion comprising a flat, round base and a circular side wall, said side wall being disposed perpendicular from the periphery of said flat base portion, said side wall having slots formed therein, said slots extending from said base the length of said wall to a rim of said side wall, said cup-shaped holder consisting of a precipitation hardened copper alloy, said contacting portion of said contact being disposed upon and affixed to said rim of said side wall, said contacting portion having approximately the same shape and cross-sectional area as said rim, said contact portion being comprising of a copper alloy.

DESCRIPTION OF THE DRAWINGS

For a better understanding of the nature of the present invention reference should be had to the following detailed discussion and drawings of which.

DESCRIPTION OF THE PREFERRED EMBODIMENT

Figure 1:
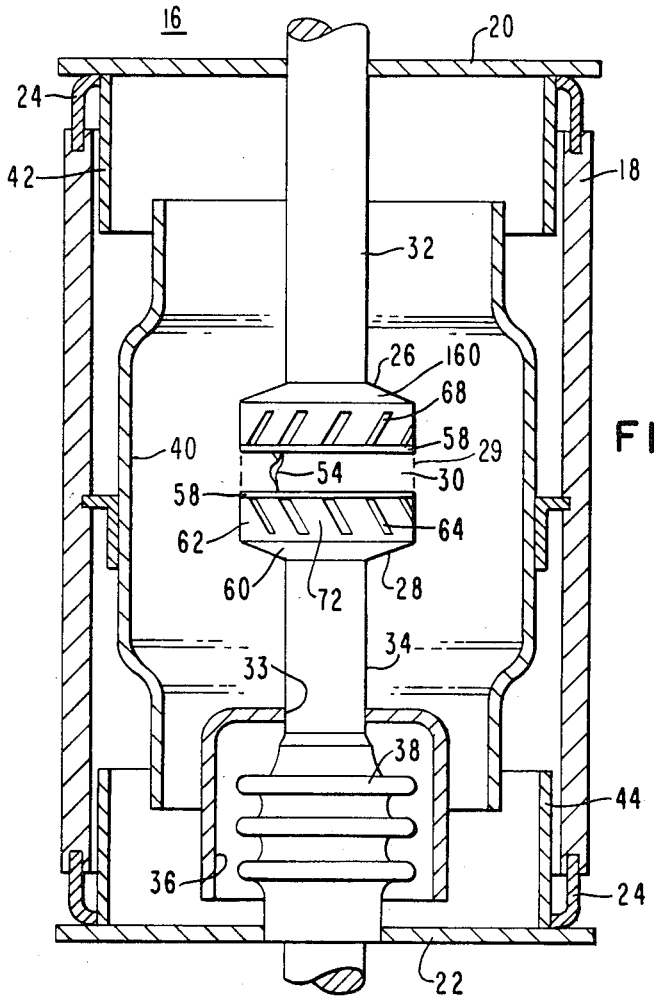
FIG. 1 is a side view of a vacuum interrupter.

With reference to FIG. 1, there is shown a vacuum interrupter 16 utilizing the teachings of the present invention. The vacuum type circuit interrupter 16 comprises a highly evacuated tubular insulating envelope 18, formed from glass or suitable ceramic material, and a pair of metallic end caps 20 and 22, closing off the end of the insulating envelope 18. Suitable seals 24 are provided between the end caps 20 and 22 and insulating envelope 18 to render the inside of the insulating envelope 18 vacuum tight. The pressure within the envelope 18 under normal operating conditions is lower than $10^{-4}$ torr to insure that the mean free path for electron travel will be longer than the potential breakdown path within the envelope 18. Located within the insulating envelope 18 are a pair of relatively movable electrodes or contacts 26 and 28, shown in FIG. 1 in their open circuit position. When the contacts 26 and 28 are separated there is formed an arcing gap 30 therebetween. The upper contact 26 is stationary, and is secured to a conducting rod 32 by suitable means, such as welding or brazing. The conducting rod 32 is rigidly joined to the stationary end cap 20 by a suitable means, such as welding or brazing. The lower contact 28 is movable and is joined to a conductive operating rod 34 by a suitable means such as welding or brazing. The operating rod 34 is suitably mounted for movement along the longitudinal axis of the insulating envelope 18. The operating rod 34 projects through an opening 33 in the bellows end cap 36 as shown in FIG. 1. A metal bellows 38 is secured in sealing relationship at its respective opposite ends to the operating rod 34 and to the opening 33 through bellows end cap 36. The flexible metallic bellows 38 provides a seal about the operating rod 34 to allow for movement of the operating rod 34 without impairing the vacuum within the insulating envelope 18.

Coupled to the lower end of the operating rod 34 is a suitable actuating means (not shown) for driving the movable contact 28 upward into engagement with the stationary contact 26 so as to close the interrupter 16. The close position of the movable contact 28 is indicated by the phantom lines 29. The actuating means is also capable of returning the movable contact 28 to its open position during circuit interruption.

When the contacts 26 and 28 are separated during circuit interruption, an arc 54 is formed at the arcing gap 30 between the contacts 26 and 28. The arc 54 which is formed between the contacts 26 and 28 vaporizes some of the contact material and these vapors and particles are dispersed from the arcing gap 30 toward the insulating envelope 18. The internal insulating surfaces of the insulating envelope 18 are protected from the condensation of the arc generated metallic vapors and particles by means of a tubular metallic shield 40 which is suitably supported. Shield 40 acts to intercept and to condense arc generated metallic vapors and particles before they can reach the insulating envelope 18. To further reduce the chances for metallic vapors or particles reaching the insulating envelope 18, by bypassing the shield 40, a pair of end shields 42 and 44 are provided at opposite ends of the main central shield 40. The speed with which the vapors, generated during arcing, are removed determines the steady state operating condition during arcing and also the recovery capability of the vacuum interrupter 16. If the vapors are not quickly removed, high voltage transients may cause the arc to reignite, after it has been extinguished, resulting in failure of the interrupter 16. The arc 54 by interacting with the main shield 40 and melting a hole therethrough, is the cause of many failures noted in prior art vacuum interrupters 16.

Figure 2:
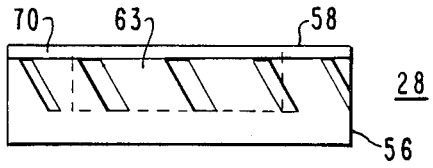
FIG. 2 is a side view of a contact embodying the teachings of this invention and suitable for use in the vacuum interrupter of FIG. 1.

With reference to FIG. 2, there is shown the contact or electrode designated either 26 or 28 in FIG. 1.

To simplify the drawing, the contact or electrode of FIG. 2 will be designated 28. It will be understood however that it is also the same as the contact designated 26 in FIG. 1.

The contact 28 has a cup-shaped holder portion 56 and a contacting portion 58.

Figure 3:
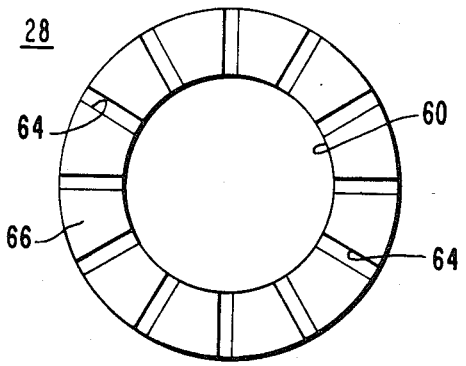
FIGS. 3 and 4 are top and side views, respectively, of the cup-shaped holder portion of the contact of FIG. 2.
Figure 4:
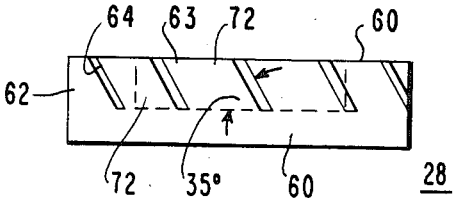

With reference to FIGS. 3 and 4 there is shown the holder portion 56 of the contact 28.

The holder portion 56 is comprised of a flat, round base 60 and a circular side wall 62. The holder potion 56 is cup-shaped with a central cavity 63 defined by the base 60 and circular side walls 62.

There are slots 64 formed in side wall 62. The slots 64 extend from base 60 to rim 66 of side wall 62.

The slots 64 ensure that any arc 54, FIG. 1, which is formed when the contacts 26 and 28 are separated during current interruption, is driven in a combined azimuthial (circumferential) and radially inward direction. This tends to confine the arc 54 to the electrode arcing gap space 30 and thereby prevents the arc 54 from interacting with or striking the arc shield 40 (FIG. 1).

The angles of the slots 52 cut into cup-shaped contact 28 can be used to establish the angular velocity and the radial position of the arc 54. Thus, if slots 68 in contact 26 are opposite the slots 64 in contact 28, when contacts 26 and 28 are disposed in a vacuum interrupter 16, face to face as shown in FIG. 1, they tend to move the arc in the same direction.

Contacts 26 and 28 are positioned so that the slotted portions of contacts 26 and 28 face each other and are constructed to produce an unbalance in the magnetic field distribution and therefore a large magnetic force to drive the arc in a specified predetermined direction.

In the particular embodiment of the vacuum interrupter 16 of FIG. 1, the slots are formed at an angle to the base 60 of approximately 35 degrees.

The contacting portion 58 of contact 28 is disposed upon and affixed by for example welding or brazing, to rim 66 of side wall 62.

The contacting portion 58 is circular in shape with an aperture 70 through its central portion.

The contacting portion 58 has a cross-sectional area which generally or approximately equals the cross-sectional area of the rim 66. The cross-sectional area of the contacting portion 58 may however be slightly larger than that of the rim 66.

The contacting portion 58 is normally comprised of a copper-chromium alloy which may vary, by weight percent, from 40% to 80% copper and 60% to 20% chromium. In addition, the contacting portion may also contain from 0.2% to 20%, by weight, bismuth or bismuth oxide.

A typical current path through the interrupter 16, with the contacts 26 and 28 closed, is through rod 34 into base 60 and to circular wall 62 and to contacting portion 58 of contact 28. The current then passes into contacting portion 158 of contact 26 through side wall 162, through base 160 and into rod 32.

It is obvious from the current path that the rods and contacts must be good electrical conductors. Normally, the rods will be of copper. The holder portion of the contact is of soft copper. The contacting portion of the contacts will normally be a copper-chromium or copper-chromium-bismuth alloy, the copper alloy being more capable of withstanding the adverse effects of arcing than copper alone. The advantages of the cup-shaped contact construction with a continuous annular contact surface, are numerous such as: (1) melting of the contact materials is avoided at low to medium current and therefore anode spot formation is prevented up to relatively high current; (2) the arc is bowed radially inward and thus prevented from interacting and burning the vapor shield 40; (3) a smaller size interrupter can be built for a given current rating than is possible with other types of contacts; (4) increase current and voltage rating can be obtained in existing models without expensive preconditioning or seasoning.

Figure 5:
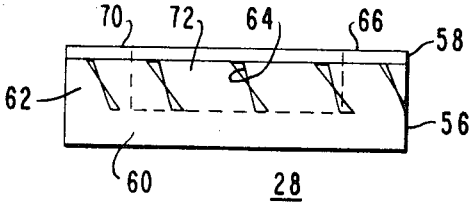
FIG. 5 is a side view of a cup-shaped holder deformed by compressive forces.

A disadvantage of the cup-shaped contact construction, however, is that the fingers 72, that portion of the side wall of the holder portion between the slots, being of soft copper move or deform as shown in FIG. 5 when the contacts are closed. This deformation increases the normal or preset contact-to-contact spacing to the extent that after about 300 or even less operations, openings and closing of the contacts, the breaker in which the vacuum interrupter 16 is assembled has to be shut down and the contact stroke readjusted.

As discussed above, attempts have been made to strengthen the cup-shaped holder by using a stronger material in place of copper, or by attempting to reinforce the copper cup-shaped holder, however, these attempts have also resulted in decreasing the electrical conductivity of the cup-shaped member.

The discovery has now been made that the cup-shaped holder can be made of high-conductivity precipitation-hardenable copper alloy which, after heat treatment, has a conductivity of 81% of copper and a yield strength of 45,000 pounds per square inch as compared to approximately 5,000 pounds per square inch for fully annealed pure copper.

Temperatures realized as a result of brazing and evacuating a vacuum interrupter can reach as high as 1000° C. which is high enough to anneal the various metal parts of the interrupter.

In particular, the copper used to make the cup-shaped holdler will be rendered "dead soft" at such a temperature and as a result will have a yield strength of only about 5,000 pounds per square inch.

A precipitation-hardenable alloy has the characteristic that, with proper heat treatment, its yield strength can be restored to a relatively high value.

Certain copper-chromium alloys, for example, when heated to 1000° C., and cooled rapidly, are solution annealed and have a yield strength of about 8,000 pounds per square inch. While this is an increase of some 60% over dead soft copper, it is still not good enough. However, if such an alloy is further heated to or maintained, a temperature of from 400° C. to 550° C. and this temperature maintained from 1 to 2 hours, preferably a temperature of 450° C. for one hour, the yield strength can be increased to approximately 45,000 pounds per square inch, an increase of 800% over soft copper. Electrical conductivity is about 81% of soft copper.

This further annealing at 400° C. to 550° C. for from 1 to 2 hours, preferably 450° C. for 1 hour, can and is easily carried out during the normal processing i.e., the brazing and evacuating of the vacuum interrupter so that no additional processing is really required.

Copper-chromium alloys which are suitable are ones containing, by weight percent, from 0.6% to 13% chromium remainder copper with preferred alloys being, by weight percent, 0.6% to 8.0% chromium, remainder copper. With a highly preferred alloy being, by weight percent, 0.6% chromium, remainder copper.

Copper-zirconium alloys are also satisfactory, with a preferred alloy being, by weight percent, 0.1% to 0.2% zirconium, remainder copper.

It should be understood that when stating the composition of copper alloys, the percent of copper stated may include trace amounts of silver.

The following Table sets forth the relative physical properties of the copper-chromium and copper-zirconium alloys discussed above.

TABLE

| Alloy (weight %) | Yield Strength Solution Annealed Soft (1000 psi) | % Electrical Conductivity IACS @ 20° C. | Yield Strength .2% Offset Soft Plus Aging @ 450° C. (1000 psi) | % Electrical Conductivity IACS @ 20° C. After Aging @ 450° C. |
|---|---|---|---|---|
| Cu (99.4%)—Cr (0.6%) | 8 | 36 | 45 | 81 |
| Cu (99.8–99.9%)—Zr (0.1–0.2%) | 14 | 70 | 18 | 84 |

From the Table it can be seen that the copper-chromium alloy increases in yield strength by 462% and in electrical conductivity by 125% after being heat treated in accordance with the teachings of this invention. The copper-zirconium alloy increases in yield strength by 28.6% and in electrical conductivity by 20% after being heat treated in accordance with the teachings of this invention.

The Table also shows that while the copper-zirconium alloy has superior electrical conductivity properties relative to the copper-chromium alloy, the copper-chromium alloy is far superior in yield strength.

An example of another copper alloy which has been found to be satisfactory for use in accordance with the teachings of this invention is:

a copper-chromium-silicon alloy sold commercially by Anaconda under the designation Anaconda 182 and having the following composition, by weight percent, 99.14% copper, 0.85% chromium and 0.1% silicon.

Two sets of contacts were made and installed in vacuum interrupters.

In one set, the cup-shaped holder was made of oxygen free high conductivity copper (OFHC) as is the usual practice.

The other set of contacts were made of a copper-chromium alloy consisting of 99.4%, by weight, copper and 0.6%, by weight, chromium.

The interrupter containing the OFHC contacts was brazed and evacuated in the normal manner.

The interrupter containing the copper-chromium alloy cup-shaped member was maintained at a temperature of 450° C. for 1 hour following brazing and evacuation.

The permanent deflections of the movable contact of the two vacuum interrupters were measured under the following conditions.

| | |
|---|---|
| Average Speed of Closing | 3.5 ft/sec. |
| Moving Mass | 1.68 pounds |
| Contact Touch Force | 220 pounds |

Figure 6:
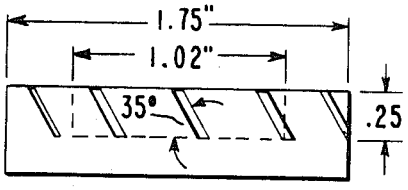
FIG. 6 is a side view of a cup-shaped holder tested in accordance with the teachings of this invention.

The identical dimensions for the two cup-shaped members tested are shown in FIG. 6.

Figure 7:
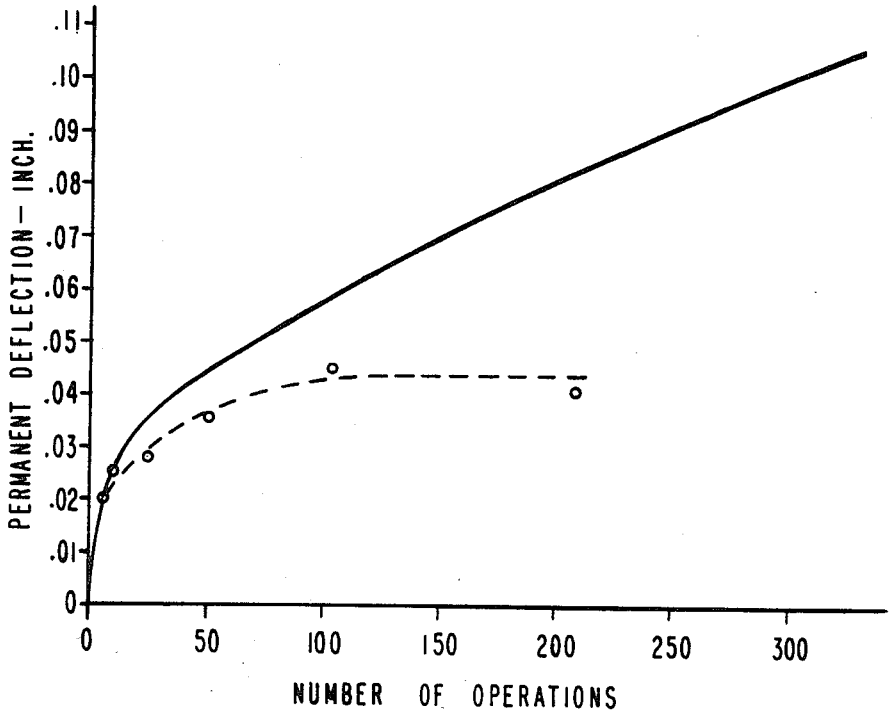
FIG. 7 is a graph showing a comparison between a prior art cup-shaped holder and a cup-shaped holder prepared in accordance with the teachings of this invention.

The results of the test are shown graphically in FIG. 7.

The graph of FIG. 7 shows a plot of Permanent Deflection In Inches, ordinate, v. Number of Operations i.e., number of times the two contacts were closed.

The dotted line represents the copper-chromium alloy contact and the solid line represents the OFHC contact.

The graph of FIG. 7 clearly shows not only is the deflection experienced by the copper-chromium cup-shaped contact less than that experienced by the OFHC contact, but also that the deflection of the copper-chromium alloy contact levels off at about 0.045 inches after about 110 operations. The 0.045 inch deflection is caused by the compression of the soft conducting rods 32 and 34 (FIG. 1). In contrast, the deflection of the OFHC contact continues to increase with every operation.

In another embodiment the slots 64 and 68 in the cup portion 56 may in some structures extend into the contacting portions 58.

While such a structure is not as strong as one in which the slots do not extend into the contact portion 58, the use of the teachings of this invention in such structures will provide a contact which will undergo less deflection than one in which the cup portion is comprised of 100%, by weight, copper.

I claim as my invention:

1. A vacuum type circuit interrupter comprising, a pair of relatively movable contacts, said contacts being relatively movable between a closed position in engagement and an open position, when in the open position said contacts form an arcing gap therebetween across which an arc can form during circuit interruption; an evacuated housing disposed about and enclosing said pair of contacts; at least one of said contacts comprising a cupshaped holder portion and a contacting portion, said cup-shaped holder portion comprising a flat, round base and a circular side wall, said side wall being disposed perpendicular from the periphery of said flat base portion, at least said side wall having slots formed therein, said side wall extending from said base portion to a rim, said cup-shaped holder consisting of a precipitation-hardened copper alloy, said contacting portion of said contact being disposed on and affixed to said rim of said side wall, said contacting portion being approximately the same shape and cross-sectional area as said rim, said contacting portion being comprised of a copper alloy.

2. The vacuum type circuit interrupter of claim 1 in which said cup-shaped holder is comprised of a precipitation-hardened copper alloy containing at least 0.40%, by weight, chromium.

3. The vacuum type circuit interrupter of claim 1 in which said cup-shaped holder is comprised of a precipitation-hardened copper alloy containing at least 0.60%, by weight, chromium.

4. The vacuum type circuit interrupter of claim 1 in which said cup-shaped holder is comprised of a precipitation-hardened copper alloy containing from 0.4% to 13%, by weight, chromium.

5. The vacuum type circuit interrupter of claim 1 in which said cup-shaped holder is comprised of a precipitation-hardened copper alloy containing from 0.6% to 8%, by weight, chromium.

6. The vacuum type circuit interrupter of claim 5 in which the contacting portion is comprised of a copper-chromium alloy.

7. The vacuum type circuit interrupter of claim 6 in which the contacting portion is comprised of a copper-chromium alloy containing, by weight, 40% to 80% copper and 60% to 20% chromium.

8. The vacuum type circuit interrupter of claim 7 in which the contacting portion also contains, by weight, 0.2% to 20% of a component selected from the group consisting of bismuth and bismuth oxide.

9. The vacuum type circuit interrupter of claim 1, in which the slots extend from said base to the rim of said side wall.

10. The vacuum type circuit interrupter of claim 1, in which the slots extend from the base through the contacting portion of said contact.

* * * * *